US010301044B2

(12) United States Patent
Hawighorst et al.

(10) Patent No.: US 10,301,044 B2
(45) Date of Patent: May 28, 2019

(54) PACKING ARRANGEMENT AND METHOD FOR PACKING A PRODUCT

(71) Applicant: Windmoeller & Hoelscher KG, Lengerich (DE)

(72) Inventors: Thomas Hawighorst, Hasbergen (DE); Martin Hohenbrink, Hagen a.T.W. (DE); Daniel Narberhaus, Lengerich (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 372 days.

(21) Appl. No.: 15/182,980

(22) Filed: Jun. 15, 2016

(65) Prior Publication Data

US 2016/0362203 A1 Dec. 15, 2016

(30) Foreign Application Priority Data

Jun. 15, 2015 (DE) ..... 10 2015 210 971

(51) Int. Cl.

| | |
|---|---|
| ***B65B 1/04*** | (2006.01) |
| ***B65B 9/20*** | (2012.01) |
| ***B65B 35/50*** | (2006.01) |
| ***B65B 57/00*** | (2006.01) |
| ***B65B 65/00*** | (2006.01) |
| ***B65B 5/06*** | (2006.01) |
| ***B65B 9/13*** | (2006.01) |

(52) U.S. Cl.

CPC ..... *B65B 1/04* (2013.01); *B65B 5/061* (2013.01); *B65B 9/135* (2013.01); *B65B 9/20* (2013.01); *B65B 35/50* (2013.01); *B65B 57/00* (2013.01); *B65B 65/003* (2013.01); *B65B 2220/16* (2013.01)

(58) Field of Classification Search

CPC .. B65B 1/04; B65B 57/00; B65B 9/20; B65B 35/50; B65B 65/003; B65B 5/061; B65B 9/135; B65B 2220/16; B65B 43/165; H04W 4/80; H04W 84/12; B65G 57/00

See application file for complete search history.

(56) References Cited

U.S. PATENT DOCUMENTS 6,691,491 B2 * 2/2004 Terminella ..... B65B 9/20 53/133.4
2016/0096273 A1 * 4/2016 Burns ..... B25J 9/1687 700/259

FOREIGN PATENT DOCUMENTS

| | | |
|---|---|---|
| DE | 102005037916 | 5/2006 |
| DE | 102008033549 | 2/2009 |
| EP | 1975073 | 10/2008 |
| EP | 2749500 | 7/2014 |
| WO | WO 2013/018074 | 2/2013 |

* cited by examiner

*Primary Examiner* — David J Walczak

(74) *Attorney, Agent, or Firm* — Jacobson Holman, PLLC.

(57) ABSTRACT

A packaging system for packaging a product into a plurality of bags or sacks includes at least one of a bagging unit, a pallet loading device, and a pallet securing device. The system also includes a device for storing and rendering available information regarding events that occurred in the system during the packaging.

8 Claims, 3 Drawing Sheets

PACKING ARRANGEMENT AND METHOD FOR PACKING A PRODUCT

BACKGROUND OF THE INVENTION

1. Field of the Invention

The invention relates to a packing arrangement and a method for packing a product in a plurality of bags or sacks.

2. Description of Related Art

Frequently, larger quantities of a product which is particularly free flowing, pourable, or flowable are packed in such a packing arrangement in quantities that can be transported.

Frequently such arrangements are not operated in an optimal way. This means that the capacities of the equipment available are not fully utilized.

SUMMARY OF THE INVENTION

The objective of the present invention is therefore to further develop a packing arrangement and a method for packing a product in a plurality of bags or sacks such that it can be operated in a more effective fashion.

The objective is attained in the features of the invention described herein. The description illustrates additional embodiments of the packing arrangement according to the invention and the inventive method, with it being possible to use the features mentioned in the context with the packaging arrangement according to the invention also in connection with the inventive method and vice versa, so that here mutually the respective features are or can be referenced.

According to the invention the packing arrangement may comprise a bagging unit, in which the product, frequently stored in a silo, is bagged into individual bags or sacks. Such arrangements are called form fill seal machines, because from a tubular material individual bags are generated, open at the top, which are also filled with the product in said device, and are sealed at the upper, open end.

According to the invention, the packing arrangement may comprise a device for placing a plurality of bags or sacks filled with the product onto a pallet, with several generally successively supplied bags being combined and arranged in a layer. Several such layers are successively stacked on a pallet until a desired height is reached.

Such a packing arrangement according to the invention may comprise a load securing device for securing the pallets loaded with bags (pallet securing device), with generally the pallet loaded with bags being wrapped with a plastic coating (stretch hood), or with a film, particularly a stretch film. Such a secured pallet can now be transported, in general.

The invention now includes one of these devices or combination thereof as desired.

According to the present invention a device is provided for storing and making available information regarding events, which occurred in this arrangement. In packing arrangements of prior art only the recipes underlying the production batch were archived. Additionally, it was known that error messages were saved.

According to the invention it is now provided that numerous events, which occur in the above-mentioned device, are saved with a lot of information relevant for this event in the device for saving and providing information. Furthermore, this information is again provided such that it particularly can be displayed and/or processed. The comprehensive knowledge of this information leads to the possibility that the arrangement can be run considerably closer to the optimal operating state than known from prior art. For example, for test purposes perhaps some processing steps, such as welding the bags [to seal them], can be shortened in their processing time and simultaneously the frequency of errors can be recorded depending on said time. Here, an event provides in a database beneficial for storing data quasi a "headline", under which the content, here the information, is collected.

In an advantageous embodiment of the invention it is provided that the device for saving and providing information regarding events is integrated in at least one device. Here, only short data paths are required for the information, and the data can be kept inside the machine so that no networks are required to allow forwarding the information of the arrangement.

Here it is particularly advantageous if the device for saving and rendering available information regarding events is integrated in the control panel of the device. This way, the device can be very easily integrated in the electric circuit of the packing arrangement. The power supply of the arrangement can therefore be produced without any problems. Additionally, a control panel is commonly very well accessible for maintenance and repair purposes, which therefore also applies for the above-mentioned device.

According to a further development of the invention, information regarding one of the following events can be saved in the device: export of data, appearance of a message, triggering of an alarm, change of a parameter of the packing or the operating parameter, change of the machine status, production of a filled bag or sack, assembly of a loaded pallet, establishment of load security, change of the operator, change of the recipe, change of the silo, inquiry of the maintenance status.

In another embodiment it is provided that the device for storing information regarding events can save the information divided into a static area and a dynamic area. Accordingly a fixed number of information cells, particularly data cells, are provided for each type of event, in which predetermined information types can be saved. However, it may happen that certain information types allocated to an event are not provided, which means the respective space at the database is not filled. Furthermore, an undetermined number of information cells are provided for the dynamic area. This means that in the event no dataset is provided for a certain type of information, here the respective, database space is not provided, either.

Here it is advantageous when in the static area the types of information time, operator, recipe, and/or machine status are provided.

In the dynamic area, additional other information can be saved, which may be dependent on an event. For example, for the event "triggering of an alarm" information can be saved regarding the type of alarm and/or the identity number of said alarm. The type of alarm is an indication relating to the error, a warning, and/or information. For the event "change of a parameter" the identity number or the identifying statement of the value (e.g., "welding temperature"), the old value, the new value, as well as the physical unit can be saved. For the event "change of the machine status" it may be sufficient to save the old machine status in the dynamic area. For the event "production of a filled hag or sack" it is advantageous on the one hand to save particularly the bag or sack number for each hag or sack, the target weight, the actual weight, the identification number of the scale by which the bag or sack was weighed, and/or the information if the bag or sack was weighed. In the context with the latter information it may be sufficient if regular sample tests of the hag weights are taken. During production it is frequently sufficient to check the bag weight at regular intervals. For the event "assembly of a loaded pallet" information may be saved such as the pallet number and the number of bags or sacks that can be loaded on it. For the event "establishment of load security" the film type and/or the number of hoods placed on top of each other may be saved. For the event "change of operator" it is advantageous to save information about the previous user in the dynamic area. For the event "change of recipe" advantageously the previous recipe can be saved, thus the recipe before the change event. For the event "change of silo" for example the identification number of the silo can be saved. For the event "inquiry into the maintenance status" advantageously the identification number of the maintenance process is saved, the maintenance interval allocated to said maintenance process, and/or a statement if the maintenance was actually performed. For all of the above-mentioned events additionally undetermined information may be saved, which may be entered by the operator, for example. This way, for example freely editable text can be saved.

In another embodiment of the invention various events and the information provided regarding these events, saved and rendered available by the device, can be accessed and filtered. This means that not all saved and recalled information is displayed for every event for example, but only data matching the selective criteria of the filter. Thus it is advantageous to provide a filter option for all information in the static area. For example, a filter may include the inquiry for all events that occurred between two points of time, in an advantageous embodiment the respective events are then displayed on a monitor. Then, an event can be selected therefrom, for example via an indicator, such as a computer mouse, or for example by the finger contacting a touch-screen. Then, for the selected event the corresponding information can be displayed from the static and/or dynamic area, while information regarding events not selected remains hidden. This way, a clear information display is generated, which helps the operator to assess only the desired information.

It is advantageous if a filter, once generated, can be saved as well, for which the above-described device can be appropriately embodied.

In another advantageous embodiment a data transmitter is provided, connecting at least two of the above-mentioned devices. This way it is possible that data is transmitted from one of the devices to one of the other devices. Thus it is possible for the operator located at one of the devices to find information about the other device and/or to operate it, without it being required that he/she has to move towards the respective device. Information regarding events of all devices can therefore be displayed on one of the operating and information systems, whereby each device may be allocated to such an operating and information system.

BRIEF DESCRIPTION OF THE DRAWINGS

Additional advantages, features, and details of the invention are discernible from the following description, in which various embodiments are described in detail with reference to the drawings. Here, the features mentioned in the claims and the description are each potentially relevant for the invention individually or in combinations of the features mentioned as desired. Within the scope of the entire disclosure, features and details described in the context of the method according to the invention also apply in the context of the inventive packing arrangement and vice versa, so that with regards to the disclosure of the individual aspects of the invention mutual reference is always made or can always be made. The individual figures show:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
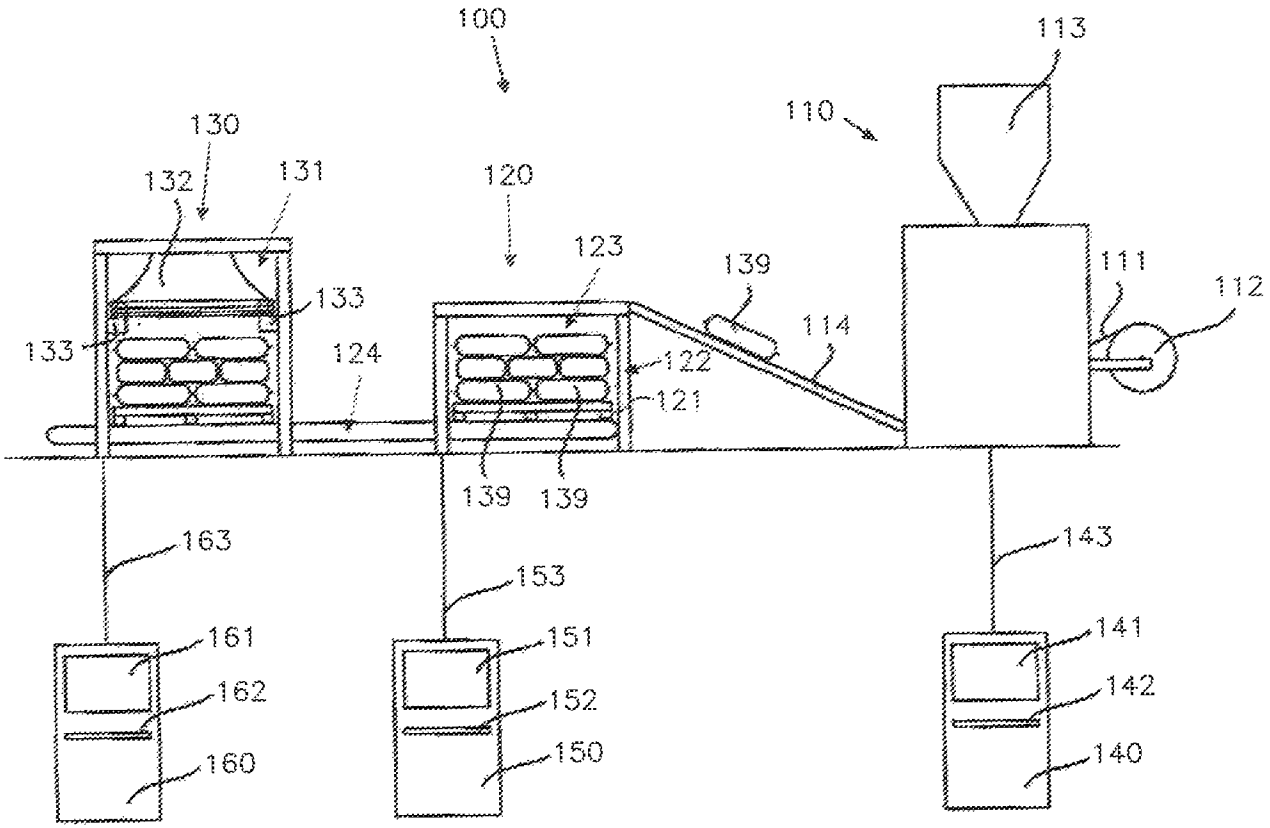
FIG. 1 schematic illustration of a packing arrangement according to the invention, FIG. 2 schematic illustration of a further packing arrangement according to the invention, FIG. 3 illustration of the function of a data filter of a packing arrangement according to the invention, FIG. 4 monitor display of a device of the packing arrangement according to the invention.

FIG. 1 shows a schematic illustration of a packing arrangement 100 according to the invention, [comprising] a bagging unit 110, a pallet loading device 120, and a load securing device 130. The bagging device 110 is supplied with a tubular packing means 111, which is stored on a roll 112. This packing means 111 is pulled off the roll 112. The front end of this packing means 111 is provided with a bottom seam and cut to a bag length such that a bag is formed, which is open towards the top. It is grasped at its upper end by a pair of graspers and transported to a filling station. Here, the upper end is pulled such that the inside of the bag becomes accessible. Now the bag can be filled with the product to be bagged, which is freely flowing, but represents a solid substance (thus is not a liquid) in the desired quantity, for example 25 kg. The product is here stored in a silo 113 and is taken therefrom. Subsequently the still open but already filled bag is moved to a sealing station, in which a head seam is applied, sealing the bag, generally by way of a welding process.

The filled bags 139 are now transported with a transport device 114, which may comprise several conveyor belts, to the pallet loading device 120. Here, several bags 139 are collected above a pallet 121 and arranged there. This arrangement of bags is placed onto the pallet and forms there a bag layer 122. In this bag layer the bags are generally arranged varying in reference to the previous bag layer, in order to this way increase the stability of the stack of bags 123.

The completely loaded pallet 121 is now moved by a conveyor device 124 to the load securing device 130, where the loaded pallet is provided with a cover, a so-called stretch hood 131. For this purpose respectively one gathering finger 133 is arranged at each corner, above the loaded pallet, on which a film hose 132 is stored showing a certain length. Subsequently the gathering fingers 133 move diagonally towards the outside, so that seen in the horizontal direction they are outside the dimensions of the pallet. Here the film hose 132 is stretched. Now the gathering fingers 133 can move downwards and here successively release the film hose so that a smooth hood develops over the loaded pallet. Before or during the downwards motion of the gathering fingers the film hose 132 is severed according to the length required and closed with a welding seam so that the hood 131 is closed at the top. The stretched hood serves not only to securely keep the bags on the pallet during transportation, but it can also serve for protection from environmental influences, such as moisture.

Each of the above-mentioned devices 110, 120, 130 comprise in this exemplary embodiment a control and information device 140, 150, 160, which saves and renders available respective information regarding events in the respective device. For this purpose, the storage device may comprise a computer and at least one bulk memory component, for example in the form of a hard drive, on a magnetic basis and/or a solid-state drive (semiconductor drive). In this storage component information can now be saved regarding various but specified events. Some of these events, for example "production of a filled bag or sack" occur continuously, while other events may occur irregularly. However, storage regarding the respective information occurs for all events.

The storage device 140, 150, 160 may respectively also comprise a monitor 141, 151, 161, on which illustrations can be displayed comprising the various information saved. Furthermore, an input device 142, 152, 162 may be provided, by which far example commands can be entered leading to the above-mentioned illustrations. Data conductors 143, 153, 163 lead from the various components of the devices to the storage device 140, 150, 160.

Figure 2:
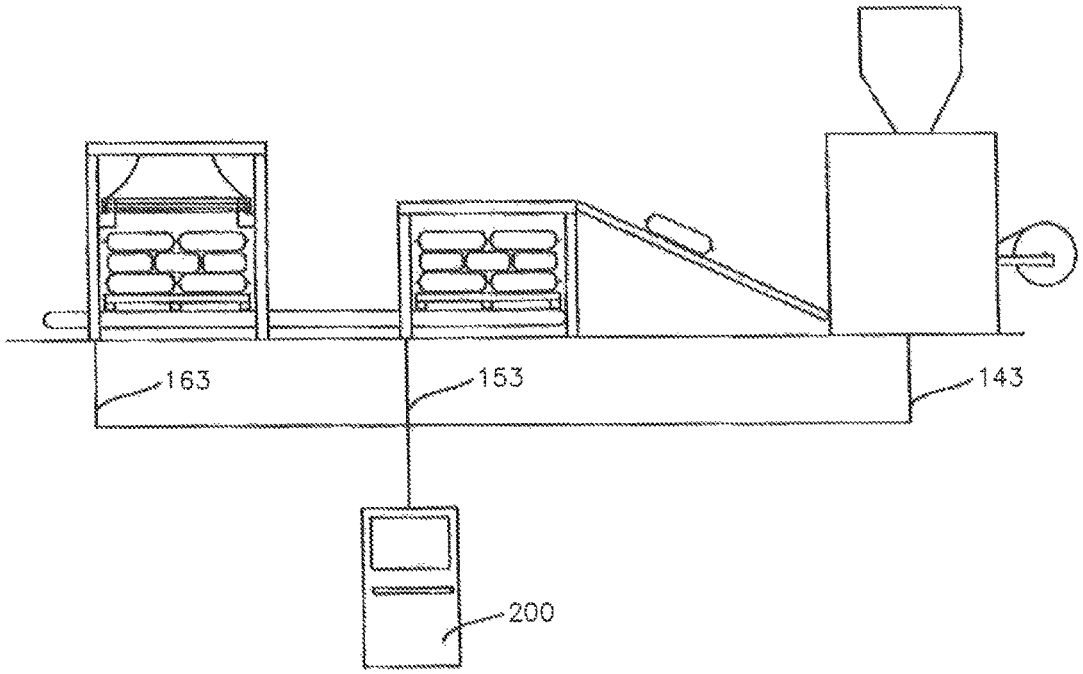

FIG. 2 shows a schematic illustration of another packing arrangement 100 according to the invention, with the devices 110, 120, 130 being equivalent to those of FIG. 1 and thus the individual reference characters not being shown for reasons of clarity. Here, a difference from the embodiment in FIG. 1 is given in that the data conductors 143, 153, 163 lead to a common storage device 200, which saves the above-mentioned information centrally for all devices. The actual storage components may alternatively be arranged in the individual devices and here save the information, which increases the operational safety, for example when one of the devices malfunctions. The storage device 200 may in this case primarily serve for information processing and illustration. This means that here the three devices 110, 120, 130 are networked together.

Figure 3:
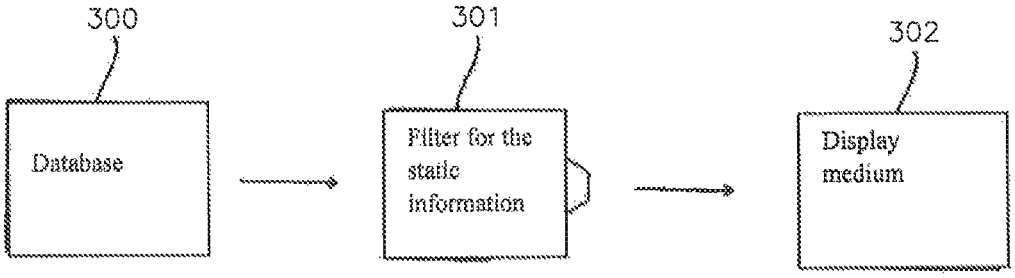

FIG. 3 shows an illustration of the function of a data filter of a packing arrangement according to the invention. Here a database is shown which provides a software connection of events and the corresponding information and organizes the storage in the storage components. Additionally, the database provides information also in case of inquiries.

In a special data inquiry, data can now be obtained in the embodiment shown, with only search criteria and/or search ranges being permitted for the static information. For example the user, the recipe, the time, and the machine can be determined for the data inquiry. For example, all information can be searched for allocated to events which occurred within the most recent 24 hours. A respective data inquiry in the dynamic information is not provided. The data inquiry is shown in FIG. 3 as filter 301. The data inquiry can then be disclosed to the user by a display medium 302, for example a monitor.

Figure 4:
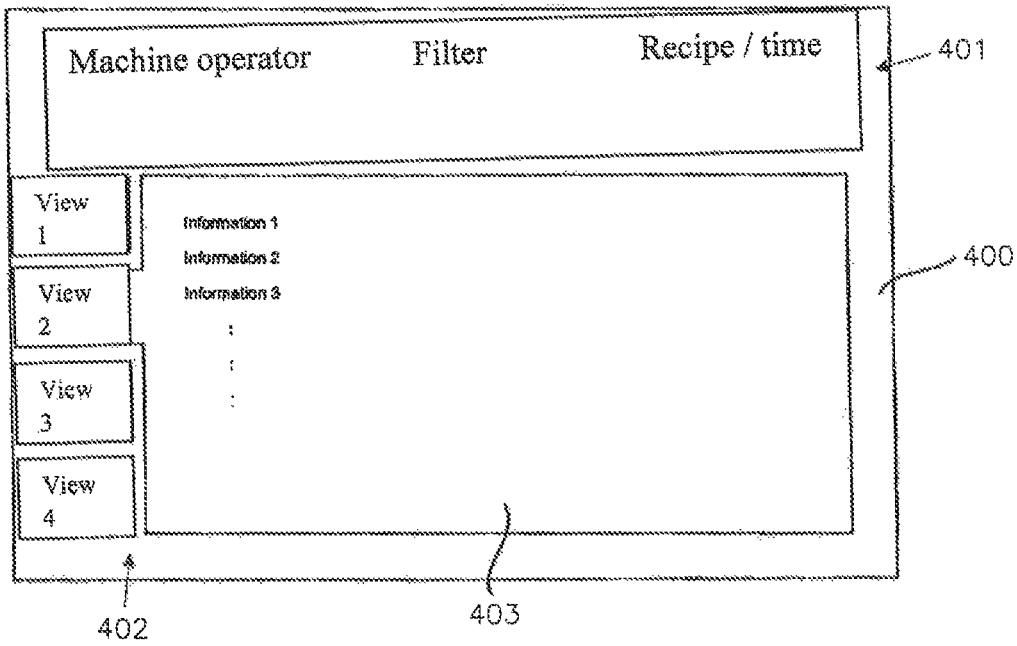

FIG. 4 shows an embodiment for an illustration of the results of a data inquiry on a monitor 400. In a display range 401 the filter is shown, i.e. the lettering "filter" represents the filter name. Under this filter name the filter can be saved with the respective search criteria. Now, all events are displayed in the illustration range 402 or all events are shown that match the static information of the search criteria. The event used is shown in FIG. 4 as view 1, view 2, etc. A view can now be selected, in which all static and/or dynamic information regarding the selected event can be displayed. For this purpose, the illustration field 403 is provided.

The exemplary embodiment of FIG. 3 and FIG. 4 serves for the simple formation of a filter as well as the clear illustration of the search results. This way, an operator can quickly be informed about important matters of the packing arrangement, such as previous maintenance work performed.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference characters

| | |
|---|---|
| 100 | Packing arrangement |
| 110 | Bagging device |
| 111 | Packing means |
| 112 | Roll |
| 113 | Silo |
| 114 | Transportation device |
| 120 | Pallet loading device |
| 121 | Pallet |
| 122 | Bag layer |
| 123 | Stack of bags |
| 124 | Conveyer device |
| 130 | Load securing device |
| 131 | Stretch hood |
| 132 | Film hose |
| 133 | Gathering fingers |
| 139 | Bags |
| 140, 150, 160 | Control and information device |
| 141, 151, 161 | Monitor |
| 142, 152, 162 | Input device |
| 143, 153, 163 | Data conductor |
| 200 | Storage device |
| 301 | Filter |
| 302 | Display medium |
| 400 | Monitor |
| 401 | Filter |
| 402 | Illustration range |
| 403 | Illustration range |

What is claimed is:

1. A packaging system for the packaging of a product in a plurality of bags or sacks, said packaging system comprising:

at least one of a bagging apparatus, a pallet loading apparatus, and a pallet securing apparatus; and a device for storing and rendering available information regarding events that happen in the packaging system during the packaging, the device being configured to divide and store the information regarding the events in a static area and in a dynamic area, with the static area for each of the events containing information regarding a time of the event, a system operator, a formula, and/or a machine status.

2. The packaging system according to claim 1, wherein the device for storing and rendering available information regarding events is integrated in the at least one apparatus.

3. The packaging system according to claim 1, further comprising a control unit in the at least one apparatus, with the device for storing and rendering available information regarding events being integrated in control unit.

4. The packaging system according to claim 1, wherein the information regarding events that is savable in the device is associated with at least one of the following events:

an export of data, an appearance of a message, a triggering of an alarm, a change of a parameter, a change of the machine status, a production of a filled bag or sack, an assembly of a loaded pallet, an establishment of a load security, a change of the operator, of the formula, a change of a silo, and an inquiry of the maintenance status.

5. The packaging system according to claim 1, wherein the various events and the information saved and rendered available by the device regarding said events is recallable and filterable.

6. The packaging system according to claim 5, wherein only the information of the static area is filterable.

7. The packaging system according to claim 1, wherein the system includes at least two of the apparatuses, with the device for saving and rendering available information regarding events related to one of the apparatuses being configured to provide the information to another of the apparatuses.

8. A method of packaging a free-flowing product, said method comprising:

at least one of bagging the product in bags or sacks, loading a plurality of the bagged bags or sacks onto a pallet; and securing the bagged bags or sacks loaded on the pallet, and storing and rendering available information regarding events that happen during the packaging, the storing and rendering available of the information being effected with a device configured to divide and store the information regarding the events in a static area and in a dynamic area, with the static area for each of the events containing information regarding a time of the event, a system operator, a formula, and/or a machine status.

* * * * *